United States Patent [19]

Parviainen

[11] Patent Number: 4,911,431

[45] Date of Patent: Mar. 27, 1990

[54] CAM STRUCTURE

[75] Inventor: Arno Parviainen, Vantaa, Finland

[73] Assignee: David International Ltd., Vantaa, Finland

[21] Appl. No.: 282,481

[22] Filed: Dec. 9, 1988

[51] Int. Cl.[4] ..... A63B 21/06

[52] U.S. Cl. ..... 272/117

[58] Field of Search ..... 272/117, 118, 134; 74/567

[56] References Cited

U.S. PATENT DOCUMENTS

| | | | |
|---|---|---|---|
| 3,746,338 | 7/1973 | Proctor | 272/118 |
| 3,858,873 | 1/1985 | Jones | 272/117 |
| 4,193,321 | 3/1980 | King | 74/567 |
| 4,416,165 | 11/1983 | Kramer et al. | 74/567 X |
| 4,478,411 | 10/1984 | Baldwin | 272/134 X |
| 4,511,137 | 4/1985 | Jones | 272/118 |
| 4,515,363 | 5/1985 | Schleffendorf | 272/118 |
| 4,563,003 | 1/1986 | Bugallo et al. | 272/118 |
| 4,621,807 | 11/1986 | Stramer | 272/117 |
| 4,709,920 | 12/1987 | Schnell | 272/117 |

FOREIGN PATENT DOCUMENTS 6082 9/1987 Norway .

*Primary Examiner*—Robert W. Bahr

*Attorney, Agent, or Firm*—Kane, Dalsimer, Sullivan, Kurucz, Levy, Eisele & Richard

[57] ABSTRACT

A cam structure for use in athletic exercise and rehabilitation apparatus, in said structure the cam (1) comprising a guiding surface (3) which is eccentric relative to the center of rotation (2) of the cam and on which a force transmission member has been disposed to be carried when the cam is rotated. The cam comprises a second eccentric guiding surface (5), the starting points (4,6) of said guiding surfaces being connected with each other so that the force transmission member can be shifted from the first (3) guiding surface onto the second (5) and back.

8 Claims, 3 Drawing Sheets

CAM STRUCTURE

FIELD OF THE INVENTION

The present invention concerns a cam structure, for use in athletic exercise and rehabilitation apparatus.

BACKGROUND OF THE INVENTION

It is common practice to use, in athletic exercise apparatus, cams by the aid of which a load of varying magnitude, depending on the degree of flexion of a joint, can be imposed on the joints and muscles which have to be exercised. Such structures are however embarrassed by the problem that one and the same cam cannot be used in exercising both the extensor and flexor muscles of an extremity because the functions of the joint at extension and at flexion are not directly equivalent in the sense that the relative loads required at a given flexion of the joint would be equal. Therefore already the initial situation, that is the distance of the starting point of the cam's guiding surface from the centre of rotation of the cam is not the same when the extremity is extended and when it is flexed. One is therefore compelled in present art to employ separate athletic exercise units when training the extensor musculature and the flexor musculature.

SUMMARY OF THE INVENTION

The object of the invention is to eliminate the drawbacks mentioned. Particularly, the aim of the invention is to provide a cam structure by the aid of which one athletic exercise apparatus or rehabilitation apparatus can be used in exercising the extensor as well as flexor muscles of extremities.

The cam structure of the invention for an athletic exercise apparatus or a rehabilitation apparatus is characterized in that therein to one cam belong two guiding surfaces which are eccentric relative to the centre of rotation of the cam, the shaping of one guiding surface being consistent with the load which the flexor muscles require and the shaping of the other guiding surface being consistent with the strain required by the extensor muscles of the same joint. Since as a rule the starting points of the guiding surfaces do not coincide, the cam furthermore advantageously comprises a connecting surface, or another equivalent support, which constitutes a connection between the starting points of said guiding surfaces. Hereby, when the force transmission member of the athletic exercise apparatus is connected with the cam, e.g. attached at the starting point of the guiding surface or in its vicinity so that it passes through the starting point of the guiding surface, the cam can be turned so that the force transmission member is carried by the connecting surface in such manner that it can be made to pass through the starting point of the other guiding surface.

Advantageously, the starting points of the guiding surfaces are located close to each other, on one and the same side of the centre of rotation of the cam, for instance on a line passing through the centre of rotation, in which case the guiding surfaces curve from their starting points in opposite directions around the centre of rotation.

Advantageously, the cam is a plate-like member, a groove on its margin forming the guiding and connecting surfaces. It is also conceivable that the edge of the cam forms a smooth surface on which e.g. a ribbon-like force transmission member is carried. Likewise, the guiding surfaces of the cam may be provided with serrations and a chain cooperating with them is used for force transmission member.

In an embodiment of the invention, the connecting surface of the cam forms an arc turning substantially through 180°, but arcs larger or smaller than this are equally possible. The purpose of the connecting surface is merely to shift the force transmission member from the starting point of one guiding surface to that of the other guiding surface. An essential feature of the connecting surface is its length, which is determined by the dead movement which the force transmission member will perform when the cam is switched from flexor setting to extensor setting or vice versa. The force transmission member will therefore always be tensely positioned at the starting points of both eccentric guiding surfaces. In an advantageous embodiment, the force transmission member has been fixed at the starting point of one of the two guiding surfaces. It is however conceivable that the force transmission member is fixed, advantageously in detachable manner, at a distance from the starting point, in which case the force transmission member is also supported at the starting point when the cam is being rotated.

The structure of the invention advantageously comprises rotating and locking means connected with the cam and by means of which the cam can be turned into the initial position which is implied by the guiding surface that is to be used in each particular instance. Advantageously, then, said rotating and locking means consist of two members disposed to be concentrically rotatable and mutually interlockable, one of them connected with the cam and the other with the operating members of the apparatus to be operated. Thus it becomes possible, by rotating said members and by appropriately interlocking them in relation to each other, both to change the guiding surface that is being used by the cam and to shift the initial position of the member operating the athletic exercise apparatus to be that which is desired.

The advantage of the invention compared with the state of art is that one athletic exercise apparatus can be used to train both the extensor and flexor muscles of extremities merely by turning the cam into desired position so that the force transmission member is located at the starting point of the desired guiding surface.

BRIEF DESCRIPTION OF THE DRAWINGS

The invention is described in detail in the following, referring to the attached drawing, wherein.

DESCRIPTION OF THE PREFERRED EMBODIMENT

Figure 1:
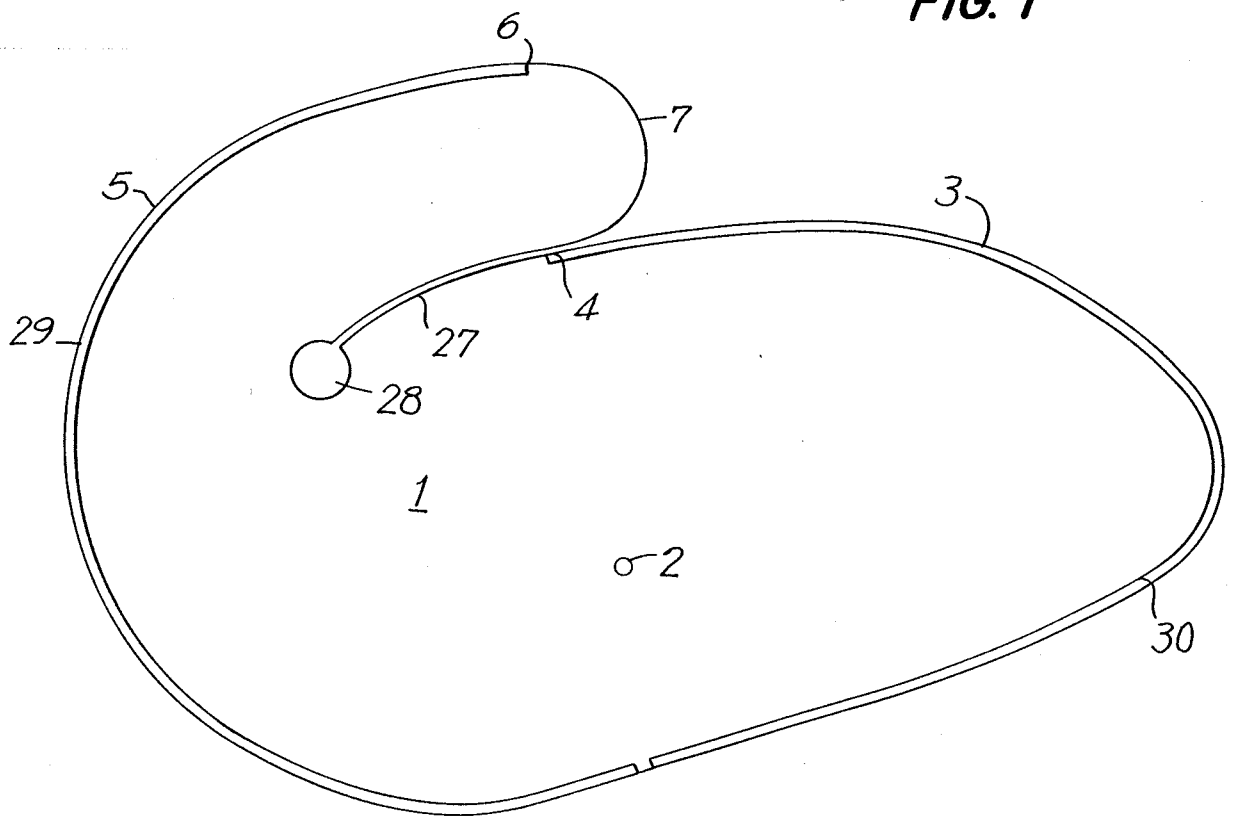
FIG. 1 presents a schematic elevational view of a cam according to the invention.

FIG. 1 presents the profile of a plate-like cam 1, which is rotatably mountable in an athletic exercise apparatus by its centre of rotation 2. On the outer margin of the plate-like cam are provided two guiding surfaces 3 and 5, which are eccentric relative to the centre of rotation, the starting points 4 and 6 of said surfaces both lying on one side of the centre of rotation and at a distance from each other. The starting points of the guiding surfaces have been connected with an arc, i.e., with the connecting surface 7. The shape of the guiding surfaces 3 and 5, that is, the variation of the distance between the centre of rotation and the guiding surface, is determined in accordance with those muscles and joints for the training of which the particular eccentric is meant. Hereby the distance of the force transmission member, or of its imagined straight extension, from the centre of rotation of the cam determines the force requirements in each instance.

The force transmission member can be attached to the cam 1 by pushing the thicker portion on the end of the force transmission member into the socket 28 and conducting it along the slit 27 onto the surface of the cam. On the surface of the eccentric, the force transmission member may find support, starting at the starting point 4, on the extensor musculature-exercising surface 30 or by suitably turning the cam, over the supporting surface 7 and starting at the starting point 6, on the flexor musculature-exerecising surface 29.

The cam of the invention is used as follows. The force transmission member, such as a rope, chain or belt, has its support at the starting point 4, whereby when the cam is rotated counter-clockwise the force transmission member is carried by the eccentric guiding surface 3 and the force requirement acting on the linkage of the athletic exercise apparatus changes in accordance with the variations of the distance between the guiding surface and the centre of rotation 2. If operation of the linkage of the athletic exercise apparatus in the opposite direction is desired, one turns the cam 1 in such a way that the force transmission member turns, resting against the connecting surface 7, and moves to the starting point 6 of the other guiding surface 5. Therefore, when hereafter the cam is rotated clockwise, that is when the linkage of the athletic exercise apparatus are moved in the direction opposite to that in which it is turned when the surface 3 is used, a different varying load will act on the linkage of the apparatus.

Figure 2:
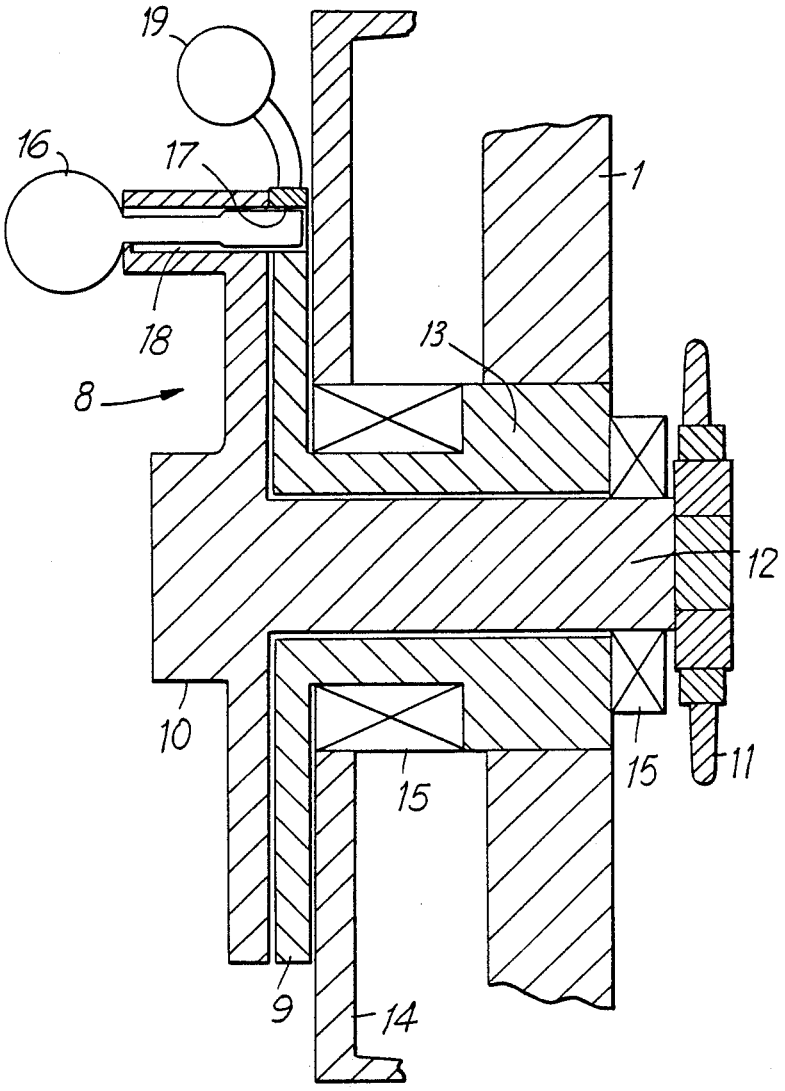
FIG. 2 presents, schematically, a rotating and locking means according to the invention.

In a structure according to the invention, depicted in sectional presentation in FIG. 2, the rotating and locking means 8 consist of two plate-like members 9 and 10 which have been disposed to be concentrically rotatable and interlockable. One of these members, 9, is fixedly connected with the cam 1, and the other member 10 is fixedly connected with the operating members 11 of the athletic exercise apparatus, said members being in this drawing represented by a sprocket wheel, which may interact with the operating linkage by a chain.

The members 9 and 10, round disks in this embodiment, are with the air of their shafts 12 and 13, fitted one in the other, carried one in the other and in the frame 14 of the apparatus, with bearings 15. Interlocking of the two plates is accomplished with a spring-loaded locking pin 16, which is mounted on the plate 10. The plate 9 is provided with a hole 17 admitting the locking pin, the spring 18 urging the locking pin into this hole so that the members 9 and 10 (the plates) become interlocked and rotate together.

Figure 3:
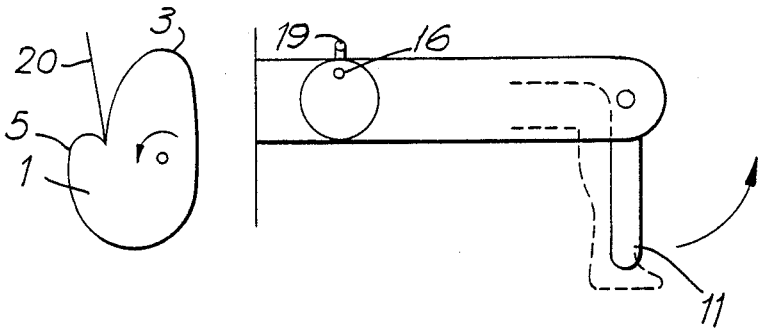
FIGS. 3–5 illustrate the use of the structure of the invention.
Figure 4:
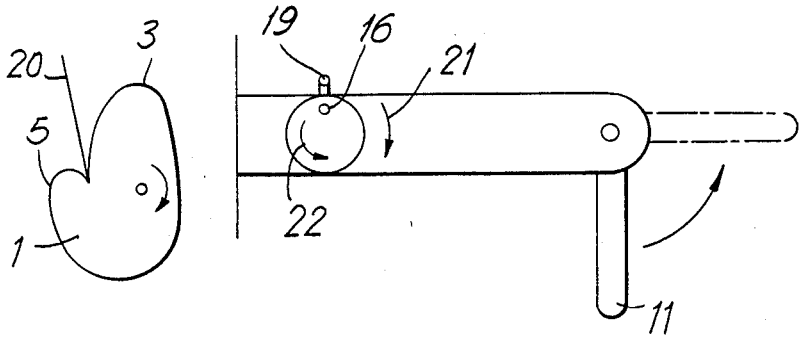
Figure 5:
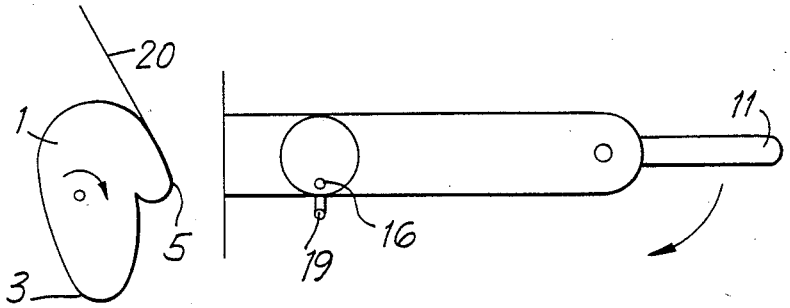

The inner plate 9 also carries a handle 19, enabling together with the locking pin 16 the members 9 and 10 to be rotated and adjusted relative to each other as follows, in the way shown in FIGS. 3-5. When exercising e.g. the leg flexor muscles, the operating member 11 of the apparatus is moved upward, as indicated by the arrow. The operating member 11 is in this case connected over the interlockable members 9 and 10 with the cam 1 in such manner that when the cam rotates, the force transmission members 20 is carried on the guiding surface 3, which imposes a given load counteractimg the movement to be performed. If it is desired to use the apparatus in exercising the flexor muscles, the locking pin 16 is pulled outward, whereafter the plates 9 and 10 may be freely rotated relative to each other. The handle 19 is then moved, as indicated by arrow 21, clockwise through 180°, whereby the cam is also rotated 180°. At the same time the locking pin 16 is moved throug 180° in the direction of arrow 22, that is counter-clockwise, whereby the operating member 11 rises into its upper position. The locking pin 16 and the corresponding hole 17 in the other plate are now in register again and the plates may therefore be interlocked. Now when the operating member 11 is pressed downward, the force transmission member 20 is carried on the other guiding surface 5 provided on the cam.

It should be noted that it is not mandatory that the members 9 and 10 are rotated one half turn in each direction: it is conceivable that in the plate 9 have been provided e.g. several holes for the locking pin 16, whereby a greater range of variation is achieved regarding the interlocking positions and the requisite rotations.

Figure 6:
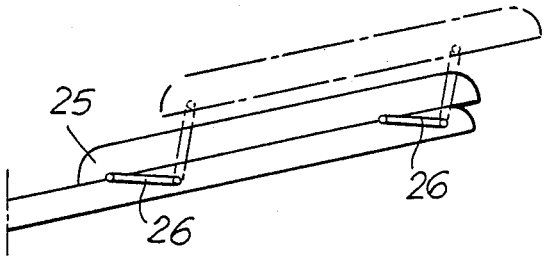
FIG. 6 presents an ancillary device of the invention.

In FIG. 6 is presented a device ancillary to the invention, devised in view of the fact that frequently when the extensor and flexor muscles are being exercised the height of the seat in the apparatus that is used is not appropriate for both kinds of exercise. In that case, advantageously, the bench 25 is attached to the frame of the apparatus with pivot arms 25, the bench thus resting immediately on the frame of the apparatus (in the lower position) or it can be lifted to be carried by the pivot arms in its upper position (dotted lines in the figure). In this way the adjustment of the seat to be in a suitable position is rapidly accomplished even while the apparatus itself is converted to be appropriate for exercising the extensor or flexor muscles, as the case may be.

It should be noted that the force transmission member may be fixed at the starting point of one of the two guiding surfaces or at another point of the cam suitably so that when the cam is rotated the force transmission member is carried on the guiding surfaces. Likewise, the connecting surface may be as shown in the figure so that the force transmission member is carried on the connecting surface when the second eccentric guiding surface is being used, or the connecting surface may be concave instead of convex, in part or all the way, so that the force transmission member at least partly goes in a straight line from one guiding surface to the other without being carried by the cam. In some rare instances it is possible that the starting points coincide nearly enough to result in practice in zero length of the connecting surface. In that case the force transmission member is carried at this common starting point in such manner that it is enabled to turn on the spot and to become carried alternatively on either one of the guiding surfaces.

What is claimed is:

1. A cam structure for use in athletic exercise and rehabilitation equipment, wherein said cam structure is connected to a force transmission member and to an operating member, said operating member providing forces of resistance against which muscle groups are to be exercised, said cam structure comprising:

a cam, said cam being a flat, rigid plate having a periphery and being rotatable about a center of rotation, said cam including a first guiding surface on said periphery, said first guiding surface being eccentric relative to said center of rotation of said cam, and carrying said force transmission member when said cam is rotated in a first direction about said center of rotation; and a second guiding surface on said periphery, said second guiding surface being eccentric relative to said center of rotation of said cam, and carrying said force transmission member when said cam is rotated in a second direction about said center of rotation opposite to said first direction, said second guiding surface having a different shape from said first guiding surface;

said first guiding surface and said second guiding surface having a first starting point and a second starting point respectively, said first starting point and said second starting point being separated from one another on said periphery of said cam, so that said force transmission member can be shifted between said first guiding surface and said second guiding surface, wherein one of said first and second guiding surfaces is used when exercising the extensor muscles of a given joint or extremity and the other of said first and second guiding surfaces is used when exercising the flexor muscles of the same joint or extremity.

2. A cam structure as claimed in claim 1 wherein said first starting point and said second starting point of said first guiding surface and said second guiding surface, respectively, on said periphery of said cam are substantially aligned with said center of rotating on one side of said center of rotation, said first guiding surface and said second guiding surface on said periphery of said cam curving in opposite directions about said center of rotation.

3. A cam structure as claimed in claim 1 wherein said periphery of said cam has a groove so that said force transmission member can be accommodated therein.

4. A cam structure as claimed in claim 1 wherein said first starting point and said second starting point on said periphery of said cam are separated from one another by a connecting surface.

5. A cam structure as claimed in claim 4 wherein said connecting surface on said periphery of said cam forms an arc turning substantially through 180°.

6. A cam structure as claimed in claim 1 wherein said force transmission member is fixed to said cam at said first guiding surface.

7. A cam structure as claimed in claim 1 further comprising:

means for rotating said cam from a first position, in which said force transmission member is carried by said first guiding surface, to a second position, in which said force transmission member is carried by said second guiding surface;

and means for locking said cam into each of said first position and said second position.

8. A cam structure as claimed in claim 7 wherein said means for rotating said cam are a first and a second concentrically rotatable, mutually interlockable member, said first concentrically rotatable, mutually interlockable member being connected to said cam, and said second concentrically rotatable, mutually interlockable member being connected to said operating member, said first and second concentrically rotatable, mutually interlockable members being rotated 180° in opposite directions when switching said cam from one of said first and second positions to the other of said first and second positions.

* * * * *